United States Patent [19]

Sieren

[11] Patent Number: 4,506,749

[45] Date of Patent: Mar. 26, 1985

[54] UNDERHOOD MUFFLER FOR TRACTOR

[75] Inventor: Gerald E. Sieren, Greendale, Wis.

[73] Assignee: Allis-Chalmers Corporation, Milwaukee, Wis.

[21] Appl. No.: 335,595

[22] Filed: Dec. 30, 1981

[51] Int. Cl.[3] ..... F01N 7/08

[52] U.S. Cl. ..... 180/69.2; 60/322; 180/309; 248/DIG. 1

[58] Field of Search ..... 180/296, 309, 69.2, 180/89.2; 248/60, 65, DIG. 1, 618; 60/280, 322; 181/204

[56] References Cited

U.S. PATENT DOCUMENTS

| | | | |
|---|---|---|---|
| B 327,674 | 1/1975 | Haupt | 180/69 R |
| 2,912,198 | 11/1959 | Feil | 248/60 |
| 3,419,892 | 12/1968 | Wagner | 60/319 |
| 3,601,343 | 8/1971 | Sivaslian | 248/637 |
| 3,743,045 | 7/1973 | Hansen | 180/69 R |
| 3,933,216 | 1/1976 | Irwin | 180/54 R |
| 4,339,919 | 7/1982 | Jobling | 180/296 |
| 4,371,047 | 2/1983 | Hale et al. | 180/69 R |

*Primary Examiner*—Joseph F. Peters, Jr.
*Assistant Examiner*—Joseph G. McCarthy
*Attorney, Agent, or Firm*—Arthur L. Nelson

[57] ABSTRACT

An underhood muffler mounted in the engine compartment of a motor vehicle supported on the turbo-charger and a resilient support supported on the engine.

9 Claims, 3 Drawing Figures

UNDERHOOD MUFFLER FOR TRACTOR

This invention relates to a muffler for an engine and more particularly to an underhood muffler supported by the turbo-charger and a resilient strut mounted on the engine to allow for thermal expansion of the muffler during normal operation.

Conventionally, tractors carry a muffler which extends externally above the engine hood. The exhaust gas fumes above the tractor away from the engine. Air cleaners also have been mounted externally of the engine hood and in some cases above the engine hood to clean the incoming air before it is supplied to the combustion chambers in the engine. Accordingly, intake and exhaust pipes extending above the tractor can be an obstruction to the visability of the operator since they are generally positioned in front of the operator station. There has been some advantage in mounting a muffler and an air cleaner in this position since it is easy to service on the conventional smaller tractor. But with the increase and size and power of the modern tractor, the serviceability becomes increasingly difficult because the size of the tractor is so large it is no longer possible to stand on the ground and reach up over the top of the tractor for servicing an air cleaner or replacing a muffler.

The Wagner et al patent, U.S. Pat. No. 3,419,892, and the Irwin patent, U.S. Pat. No. 3,933,216, show exhaust systems. The Wagner et al patent shows an exhaust ejector for exhausting fumes from the internal combustion engine which extends upwardly from the tractor and is adapted for extending through the engine hood for discharge of exhaust gases. The Irwin patent shows the intake and the air cleaner and air strainer mounted on the intake pipe which supplies clean air to the internal combustion engine. Associated with the intake pipe is also an exhaust pipe which extends vertically along the front corner post of the vehicle cab. The applicant's invention, however, has positioned the air cleaner in an auxiliary compartment immediately in front of the radiator and the muffler immediately above the engine and under the engine hood. The muffler is mounted on the turbo-charger and a resilient strut which are supported by the engine. The exhaust pipe extends upwardly from the muffler to discharge exhaust gases to the atmosphere.

Applicant's invention includes an underhood muffler with an exhaust pipe extending upwardly through the engine hood. An air cleaner is also provided in an auxiliary compartment immediately in front of the radiator with conduit means for supplying air to the compressor of the turbo-charger which in turn is supplied to the combustion chambers of the internal combustion engine. The applicant's muffler and air cleaner can be easily serviced by removing the side panel of the engine hood.

It is an object of this invention to provide an underhood muffler for an internal combustion engine.

It is another object of this invention to provide an underhood muffler and an air cleaner both mounted underneath the engine hood.

It is a further object of this invention to provide an underhood muffler for an internal combustion engine supported by a discharge pipe from the turbo-charger and a supporting strut which is also supported on the engine and being flexible to allow for thermal expansion of the muffler.

It is a further object of this invention to provide an underhood muffler supported on an internal combustion engine through a turbo-charger discharge pipe and a resilient strut to allow for thermal expansion of the muffler.

The objects of this invention are accomplished with an internal combustion engine mounted in an engine compartment defined by the hood. A turbo-charger mounted on the engine with an exhaust discharge pipe extending to support the muffler. The exhaust pipe extends from the muffler through the engine hood to discharge exhaust gases into the atmosphere. The rear end of the muffler is mounted on a resilient supporting strut supported on the engine which is flexible to allow expansion of the muffler during normal operation.

Referring to the drawings.

Figure 1:
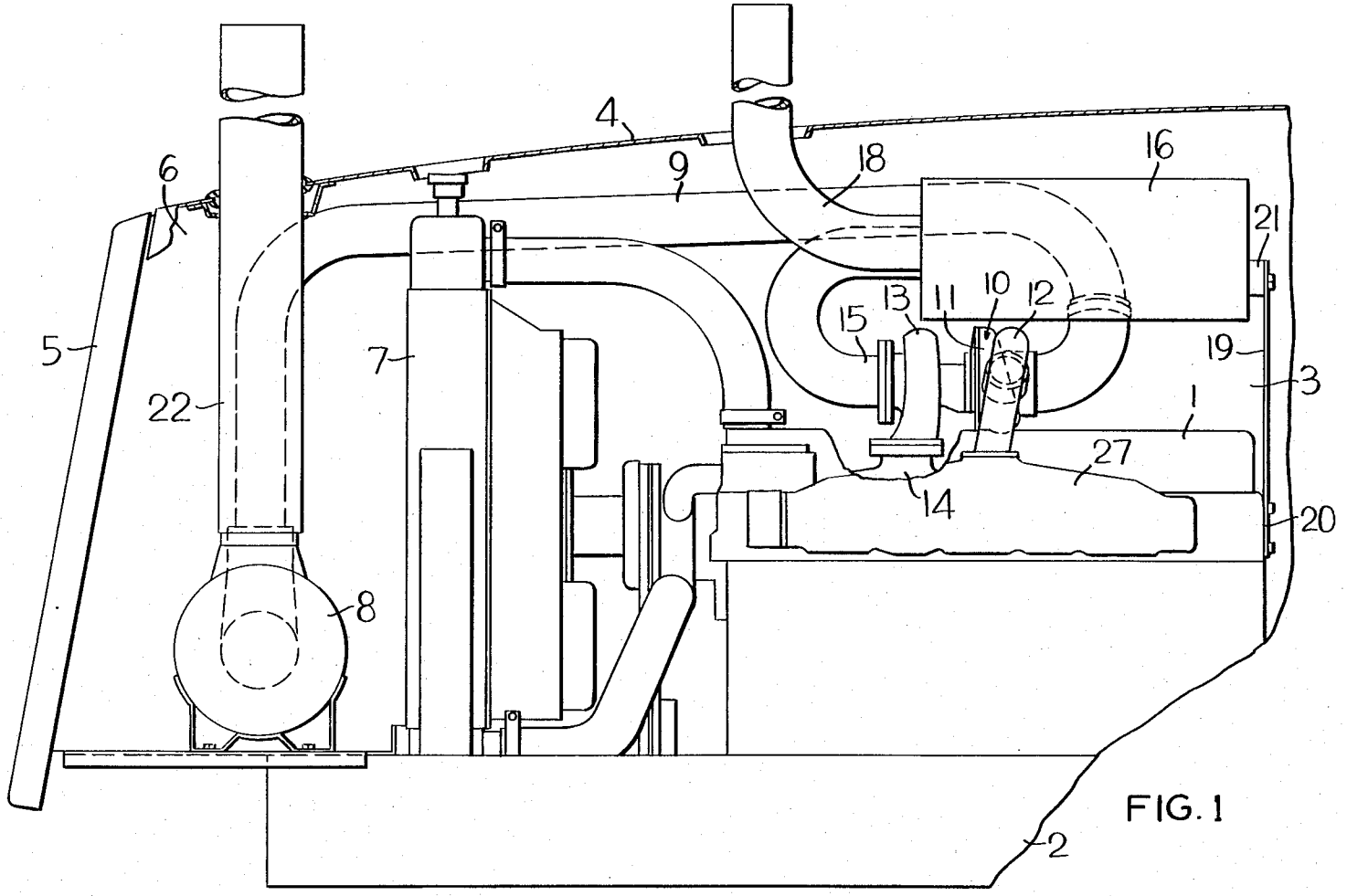
FIG. 1 illustrates a side elevation view of the internal combustion engine and the supporting structure for the underhood muffler.

Referring to the drawings, the engine 1 is supported on the vehicle chassis 2 in the engine compartment 3. The engine compartment is defined by the engine hood 4. The engine hood 4 extends forwardly to the grille 5 to form the auxiliary compartment 6 with the radiator 7. The engine hood 4 includes removable side panels 104 and 105. Removal of the side panel 105 provides access to muffler 16 and air cleaner 8 for servicing. The air cleaner 8 is positioned in the auxiliary compartment 6 and has conduit 9 extending rearwardly to the turbo-charger 10. The turbo-charger 10 includes a compressor 11 which compresses air which in turn is supplied to the intake manifold 27 through the cross passage 12 over the internal combustion engine. The turbine 13 is mounted on the exhaust manifold 14 and discharges expanded exhaust gases through the discharge passage 15. Discharge passage 15 supports the muffler 16. After the gases have passed through the muffler 16, they are exhausted through the exhaust pipe 18 which extends upwardly through the hood 4. The muffler 16 is supported by the flexible strut 19 which is supported on the rear end 20 of the engine 1. The flexible strut 19 extends upwardly to the bracket 21 which is fastened to the rear end of the muffler 16.

Figure 2:
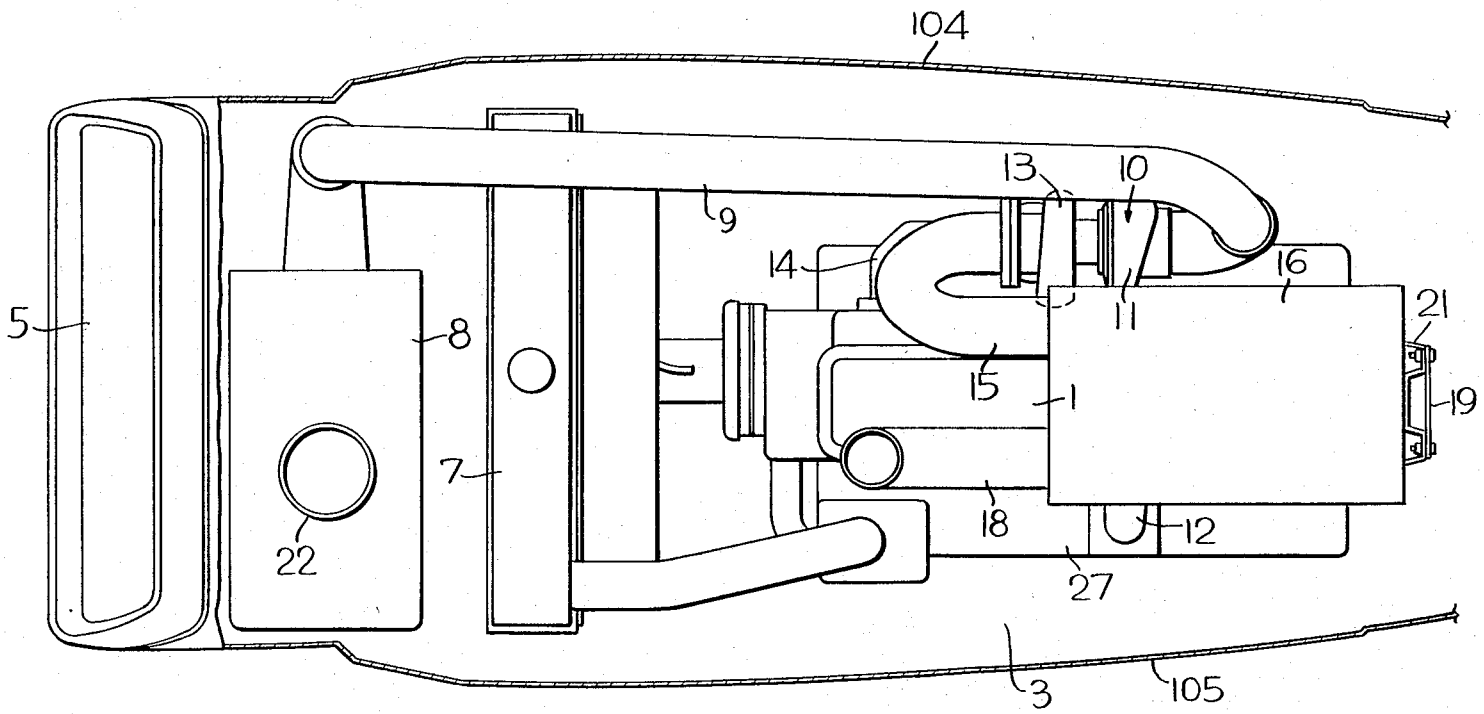
FIG. 2 is a plan view of the underhood muffler showing the supporting structure for the muffler.
Figure 3:
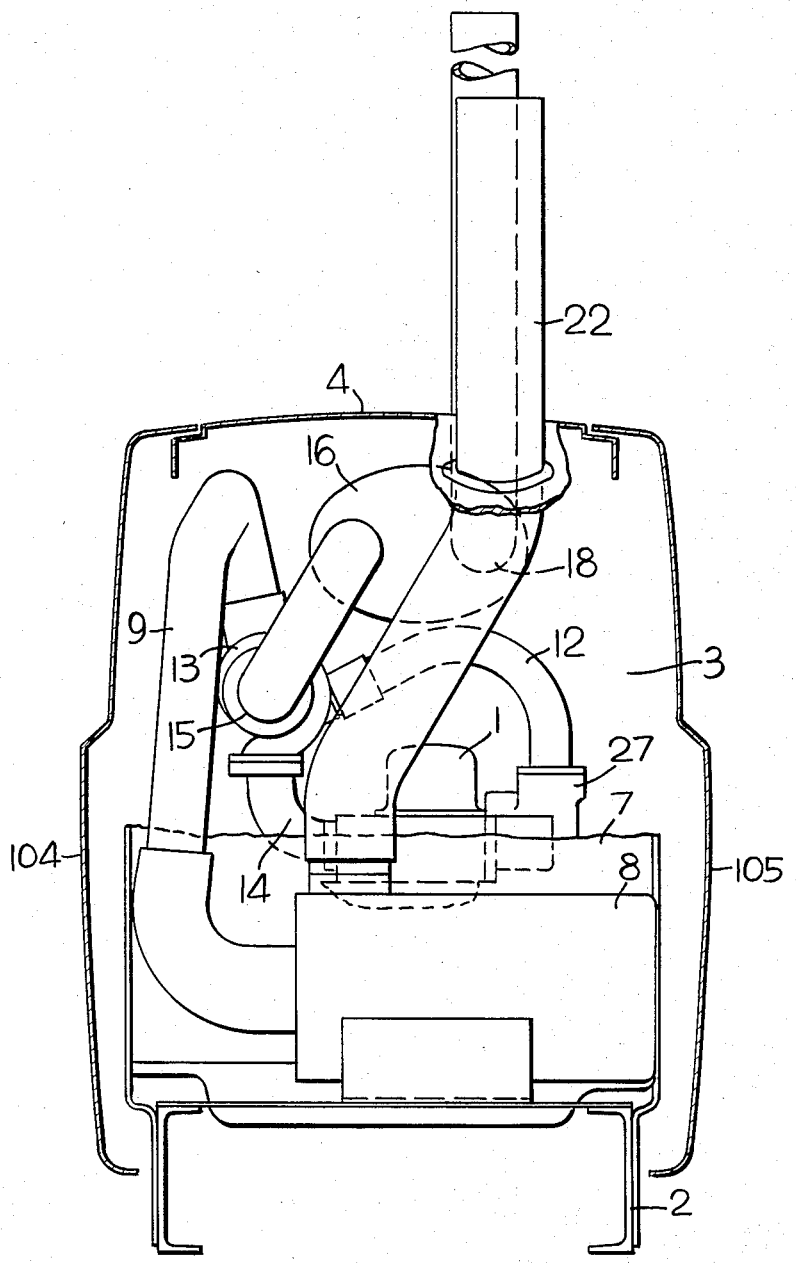
FIG. 3 is an end view of the engine, air cleaner and underhood muffler.

Referring to FIG. 3, the inlet pipe 22 for the air intake is shown extending through the engine hood into the auxiliary compartment 6 and to the air cleaner 8. Air passing through the air cleaner 8 then passes through the conduit 9 rearwardly to the compressor 11 of the turbo-charger 10. The exhaust manifold 14 is shown supported on the engine 1. Discharge pipe 15 extends upwardly to support the front end of the muffler 16. FIG. 2 shows the muffler supported by the discharge pipe 15 with exhaust pipe 18 extending upwardly through the hood. The bracket 21 carries muffler 16 which in turn is carried by the strut 19 which consists of a plate mounted on the engine. The plate is flexible and can flex as the muffler becomes heated to allow for thermal expansion.

The engine 1 mounted on the vehicle chassis 2 provides a support for the turbo-charger 10. The turbo-charger 10 mounted on the exhaust manifold 14 supports the muffler 16 through the discharge passage 15.

The air cleaner 8 is mounted in the auxiliary compartment 6 and receives air supply through the inlet pipe 22 from the atmosphere. The air cleaner cleans the air and then supplies the air through the conduit 9 to the compressor 11 of the turbo-charger 10. A cross over passage 12 supplies air to the intake manifold 27 and the combustion chamber of the internal combustion engine. The muffler 16 and the air cleaner 8 can be serviced by removal of the side panel of the engine hood. Accordingly, the intake and exhaust systems are conveniently located for servicing since the operator of the vehicle can readily gain access to the engine compartment and the auxiliary compartment.

The embodiments of the invention in which an exclusive property or privilege is claimed are defined as follows:

1. An underhood muffler for an internal combustion engine on a tractor comprising, an engine hood defining an engine compartment, an internal combustion engine in the engine compartment, a muffler carrying an exhaust pipe mounted between said hood and engine, said exhaust pipe extending through an opening in said hood, an exhaust manifold on said engine, an exhaust gas passage means partially supported by said exhaust manifold and partially supporting said muffler, a flexible muffler support plate mounted on said engine partially and nonrotatably supporting said muffler on at least two points and allowing axial thermal expansion of said muffler during normal operation.

2. An underhood muffler for an internal combustion engine on a tractor as set forth in claim 1 including, an intake manifold partially supporting said passage means.

3. An underhood muffler for an internal combustion engine on a tractor as set forth in claim 2 wherein said exhaust gas passage means on said manifolds includes a turbo-charger having an exhaust discharge pipe for supporting said muffler.

4. An underhood muffler for an internal combustion engine on a tractor as set forth in claim 2 including, an air cleaner mounted under said engine hood, said exhaust gas passage means defining a turbo-charger, conduit means connecting said air cleaner to said turbo-charger, said turbo-charger including a compressor receiving air from said conduit means for supplying air to said intake manifold.

5. An underhood muffler for an internal combustion engine on a tractor as set forth in claim 1 wherein said passage means includes a turbo-charger, said exhaust gas turbo-charger includes an air compressor, an air cleaner mounted within said engine hood for supplying air to said air compressor.

6. An underhood muffler for an internal combustion engine on a tractor as set forth in claim 1 wherein said hood defines an auxiliary compartment, said exhaust gas passage means defines a turbo-charger, an air cleaner received within said auxiliary compartment, an inlet air conduit means connected between said air cleaner and said turbo-charger.

7. An underhood muffler for an internal combustion engine on a tractor as set forth in claim 1 wherein said muffler support plate includes at least two bolts on said plate supporting one end of said muffler to provide a three-point support of said muffler for maintaining alignment of the exhaust pipe in the opening of said hood.

8. An underhood muffler for an internal combustion engine on a tractor as set forth in claim 6 wherein said hood includes a removable side panel permitting access to said muffler and said air cleaner for servicing.

9. An underhood muffler for an internal combustion engine on a tractor as set forth in claim 1 including an intake manifold, said exhaust gas passage means including a turbo-charger mounted on said manifolds and having a turbine discharge passage supporting said muffler.

* * * * *

UNITED STATES PATENT OFFICE

CERTIFICATE OF CORRECTION

Patent No. 4,506,749 Dated March 26, 1985

Inventor(s) Gerald E. Sieren

It is certified that error appears in the above-identified patent and that said Letters Patent are hereby corrected as shown below:

Column 4, line 8, after "said" insert --- exhaust gas ---;

line 9, cancel "exhaust";

line 10, cancel "gas".

Signed and Sealed this

*Fourteenth* Day of *January 1986*

[SEAL]

*Attest:*

DONALD J. QUIGG

*Attesting Officer*

*Commissioner of Patents and Trademarks*